US006914587B2

(12) United States Patent
Kosaka

(10) Patent No.: US 6,914,587 B2
(45) Date of Patent: Jul. 5, 2005

(54) SIGNAL LINE DRIVING CIRCUIT AND SIGNAL LINE DRIVING METHOD FOR LIQUID CRYSTAL DISPLAY

(75) Inventor: Ryosuke Kosaka, Tokyo (JP)

(73) Assignee: NEC Electronics Corporation, Kanagawa (JP)

( * ) Notice: Subject to any disclaimer, the term of this patent is extended or adjusted under 35 U.S.C. 154(b) by 226 days.

(21) Appl. No.: 10/061,305

(22) Filed: Feb. 4, 2002

(65) Prior Publication Data

US 2002/0105492 A1 Aug. 8, 2002

(30) Foreign Application Priority Data

Feb. 2, 2001 (JP) ..... 2001-027042

(51) Int. Cl.[7] ..... G09G 5/00; G09G 3/36

(52) U.S. Cl. ..... 345/89; 345/215; 345/89; 345/98

(58) Field of Search ..... 345/89, 95, 98, 345/215, 589–605, 690

(56) References Cited

U.S. PATENT DOCUMENTS

| | | | | |
|---|---|---|---|---|
| 5,844,533 A | * | 12/1998 | Usui et al. | 345/89 |
| 6,100,867 A | * | 8/2000 | Gyouten | 345/95 |
| 6,320,562 B1 | * | 11/2001 | Ueno et al. | 345/89 |
| 6,333,727 B2 | * | 12/2001 | Mizumaki | 345/89 |
| 6,483,494 B1 | * | 11/2002 | Liaw et al. | 345/99 |
| 6,661,402 B1 | * | 12/2003 | Nitta et al. | 345/99 |

FOREIGN PATENT DOCUMENTS

| | | | | |
|---|---|---|---|---|
| JP | 5-297827 | | 11/1993 | |
| JP | 7-65580 | | 3/1995 | |
| JP | 8-87248 | | 4/1996 | |
| JP | 8-304763 | | 11/1996 | |
| JP | 08340505 A | * | 12/1996 | H04N/5/66 |
| JP | 9-159993 | | 6/1997 | |
| JP | 10-11032 | | 1/1998 | |
| JP | 2853764 | | 11/1998 | |

* cited by examiner

*Primary Examiner*—Bipin Shalwala
*Assistant Examiner*—Laurel E. LeFlore
(74) *Attorney, Agent, or Firm*—Young & Thompson

(57) ABSTRACT

In order to attain an electric power saving for a liquid crystal display having a pre-charging unit, a signal line driving circuit according to the present invention is used in an active matrix type of a liquid crystal display, and it is characterized in that it applies a middle potential Vp serving as a pre-charging voltage and a gradation voltage corresponding to a picture data to a plurality of signal lines, and it has a latch 11 and a comparator 12 for comparing a picture data before one horizontal period with a picture data to be next displayed for each signal line, and a switch controller 13 for applying the middle potential Vp in accordance with the result compared by the comparator 12, and if a writing operation can be stably carried out at a high speed without any pre-charging operation, the pre-charging operation is not done. Thus, it is possible to reduce a loss of a current necessary for the pre-charging operation.

23 Claims, 10 Drawing Sheets

Usui et al.

The present invention

SIGNAL LINE DRIVING CIRCUIT AND SIGNAL LINE DRIVING METHOD FOR LIQUID CRYSTAL DISPLAY

BACKGROUND OF THE INVENTION

1. Field of the Invention

The present invention relates to a signal line driving circuit and a signal line driving method, which are used in a liquid crystal display, such as an active matrix type and the like, and suitable for a small consumptive electric power.

2. Description of the Related Art

In a recent liquid crystal display, a driving circuit having a high current driving performance and a small consumptive electric power has been required in association with a larger size of a liquid crystal panel and a higher picture quality. As a display satisfying such a requisition, a liquid crystal display having a pre-charging unit is well known (for example, Japanese Laid Open Patent Application (JP-A-Heisei, 8-87248). This pre-charging unit applies a predetermined standard potential to a signal line immediately before applying a gradation signal to a pixel capacitor arranged on the liquid crystal panel. Accordingly, a load on an output unit of the driving circuit can be reduced to thereby attain an electric power saving. Also, a dispersion in the load for each TFT can be suppressed to thereby attain a stably displaying operation.

FIG. 9 is a circuit diagram showing a conventional liquid crystal display having such a pre-charging unit. It will be described below with reference to FIG. 9.

A pre-charging circuit as a pre-charging unit 25 is provided with: switches SW11, SW21, . . . , SWn1 for connecting signal lines S1, S2, . . . , Sn and output sides of a signal line driver 22, respectively; and switches SW12, SW22, . . . , SWn2 for connecting the signal lines S1, S2, . . . , Sn and a middle potential Vp, respectively. The respective switches SW11, SW12, . . . , SW1*n* are operated on the basis of a signal sent by a timing generator 21.

FIG. 10 is a block diagram showing an example of the signal line driving circuit in the liquid crystal display of FIG. 9. FIG. 11 is a timing chart showing the operation of the signal line driving circuit of FIG. 10. It will be described below with reference to FIGS. 9 to 11.

The signal line driver 22 is provided with: a shift register 31 operated in accordance with a clock signal CLK; a data register 32, which is controlled by an output of the shift register 31, for storing m-bit picture data in parallel; a data latch 33 for collectively transferring and storing the picture data on the basis of a control signal LP; a decoder 34 of an m-bit input; an analog switch 35 for selecting a gradation voltage from 2m voltages inputted from a gradation voltage generator 37 and outputting it; an output circuit 36 for outputting the gradation voltage outputted from the analog switch 35 to the pre-charging circuit 25; and the pre-charging circuit 25.

The switches SWn1, SWn2 are respectively turned on and off in accordance with pulse signals SP1, SP2 sent from the external timing generator 21.

As can be understood from periods T1, T2 of FIG. 11, the conventional signal line driving circuit always carries out the pre-charging operation irrespectively of the gradation voltage sent before and after a horizontal period. Such a pre-charging operation is the very effective unit in applying a gradation voltage having a different polarity such as one dot inversion drive. However, if a gradation voltage of a picture data to be next displayed is equal to a gradation voltage of a picture data before the one horizontal period or it is within a certain range of that gradation voltage, the execution of the pre-charging operation causes a voltage fluctuation in the signal line to be larger, which results in a problem that a consumptive electric power is conversely increased correspondingly to the voltage fluctuation.

By the way, especially in the field of various portable apparatuses such as a portable telephone terminal and the like, the size of the liquid crystal panel is limited because of that property. Thus, a current driving performance equal to that of a driver of a large liquid crystal panel is not required. However, the electric power saving is further desired.

It is therefore an object of the present invention to provide a liquid crystal display and a signal line driving circuit, in which a consumptive electric power is further dropped by improving the above-mentioned problems.

SUMMARY OF THE INVENTION

A signal line driving circuit according to the present invention is characterized in that it applies a pre-charging voltage and a gradation voltage corresponding to a picture data to a plurality of signal lines, and it has a picture data comparator for comparing a picture data before one horizontal period with a picture data to be next displayed for each signal line, and a switch controller for controlling a supply of the pre-charging voltage in accordance with a result compared by the picture data comparator. A signal line driving method according to the present invention is characterized in that it is used in a signal line driving circuit according to the present invention and it compares a picture data before one horizontal period with a picture data to be next displayed for each signal line and controlling a supply of the pre-charging voltage in accordance with that compared result.

If a difference between the gradation voltage applied before one horizontal period and the gradation voltage of the picture data to be next displayed is small, the pre-charging operation is not always necessary. In such a case, the pre-charging operation can be omitted to thereby attain the electric power saving. The switch controller is operated, for example, as described in the following items (1) to (5).

(1) If the gradation voltage of the picture data to be next displayed is within a certain range of the gradation voltage of the picture data before one horizontal period, the pre-charging voltage is not applied. [Certain Range] implies the range in which the pre-charging operation is not necessary and it is set theoretically or experimentally.

(2) If the gradation voltage of the picture data to be next displayed agrees with the gradation voltage of the picture data before the one horizontal period, the pre-charging voltage is not applied.

(3) Only if a polarity of the gradation voltage of the picture data to be next displayed is different from a polarity of the gradation voltage of the picture data before the one horizontal period, the pre-charging voltage is applied. If the polarity of the gradation voltage in the one horizontal period is inverted, a change amount of the gradation voltage is large. Since the pre-charging operation is executed only in such a case, it is possible to attain the electric power saving.

(4) If the polarity of the gradation voltage of the picture data to be next displayed is different from the polarity of the gradation voltage of the picture data before the one horizontal period, the pre-charging voltage is applied.

(5) If the gradation voltage of the picture data to be next displayed is higher than the gradation voltage of the picture data before the one horizontal period, a first operational amplifier suitable for a boosting operation is used to apply the gradation voltage. If the gradation voltage of the picture data to be next displayed is lower than the gradation voltage of the picture data before the one horizontal period, a second operational amplifier suitable for a voltage drop operation is used to apply the gradation voltage. If the gradation voltage of the picture data to be next displayed is equal to the gradation voltage of the picture data before the one horizontal period, any one of the first and second operational amplifiers is used to apply the gradation voltage. By the way, [Suitability for Boosting Operation] implies, for example, [Enabling Electric Power Saving for Boosting Operation], and [Suitability for Voltage Drop Operation] implies, for example, [Enabling Electric Power Saving for Voltage Drop Operation].

DETAILED DESCRIPTION OF THE PREFERRED EMBODIMENTS

Figure 1:
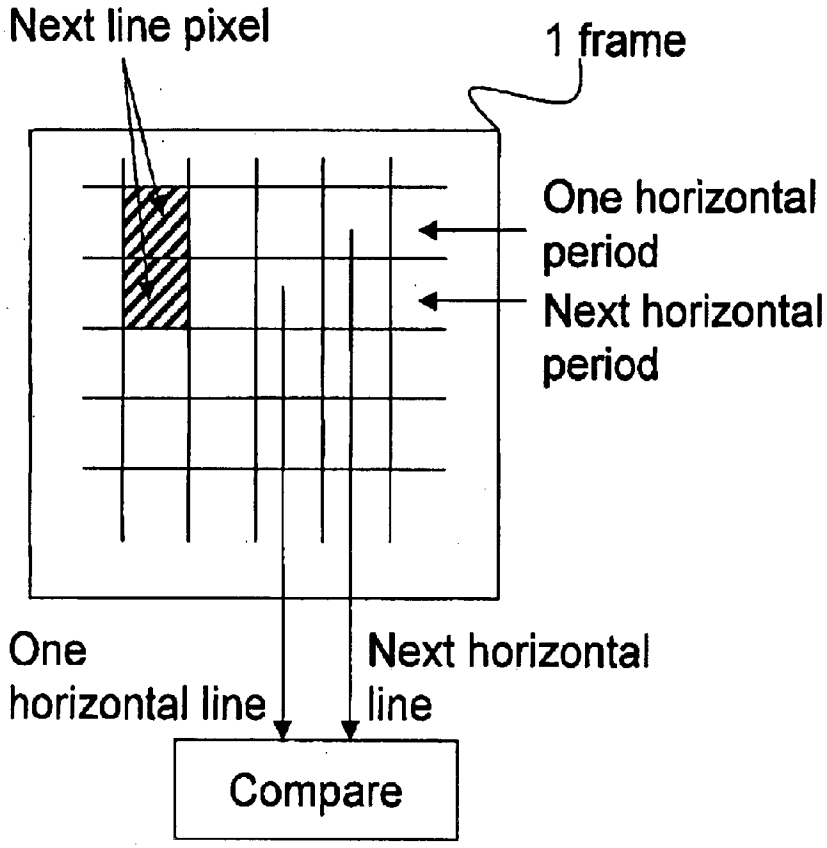
FIG. 1 is a block diagram showing a first embodiment of a signal line driving circuit according to the present invention.

FIG. 1 is a block diagram showing a first embodiment of a signal line driving circuit according to the present invention. It will be described below with reference to FIG. 1.

A signal line driving circuit in this embodiment is used in an active matrix type of a liquid crystal display. It supplies a middle potential Vp serving as a pre-charging voltage and a gradation voltage corresponding to a picture data to a plurality of signal lines. It is characterized in that it is provided with: a latch 11 and a comparator 12 serving as a picture data comparator for comparing a picture data before one horizontal period with a picture data to be next displayed for each signal line; and a switch controller 13 serving as a switch controlling unit for supplying the middle potential Vp in accordance with the compared result by the comparator 12.

Figure 10:
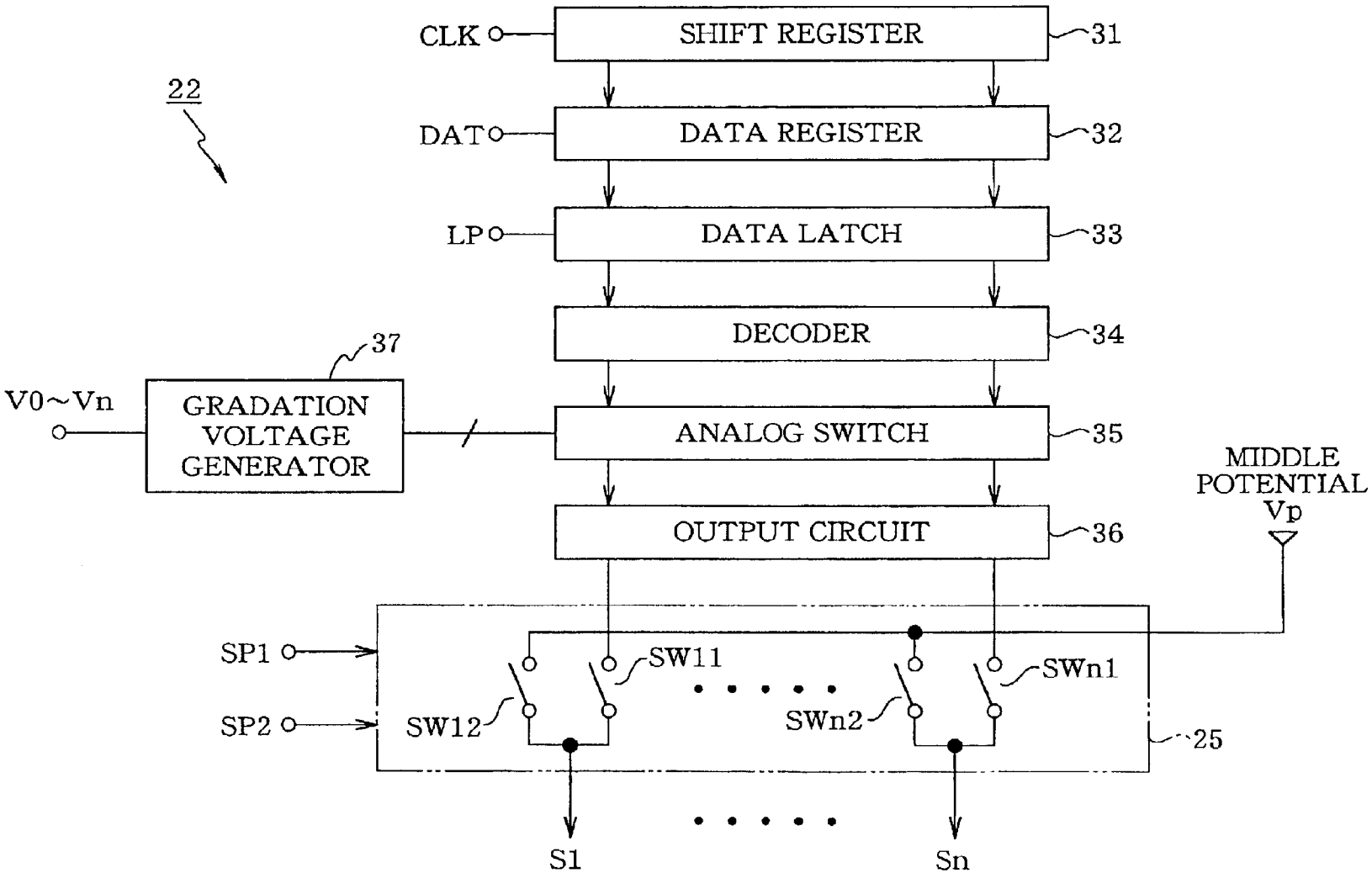
FIG. 10 is a block diagram showing an example of a signal line driving circuit in the conventional liquid crystal display.
Figure 11:
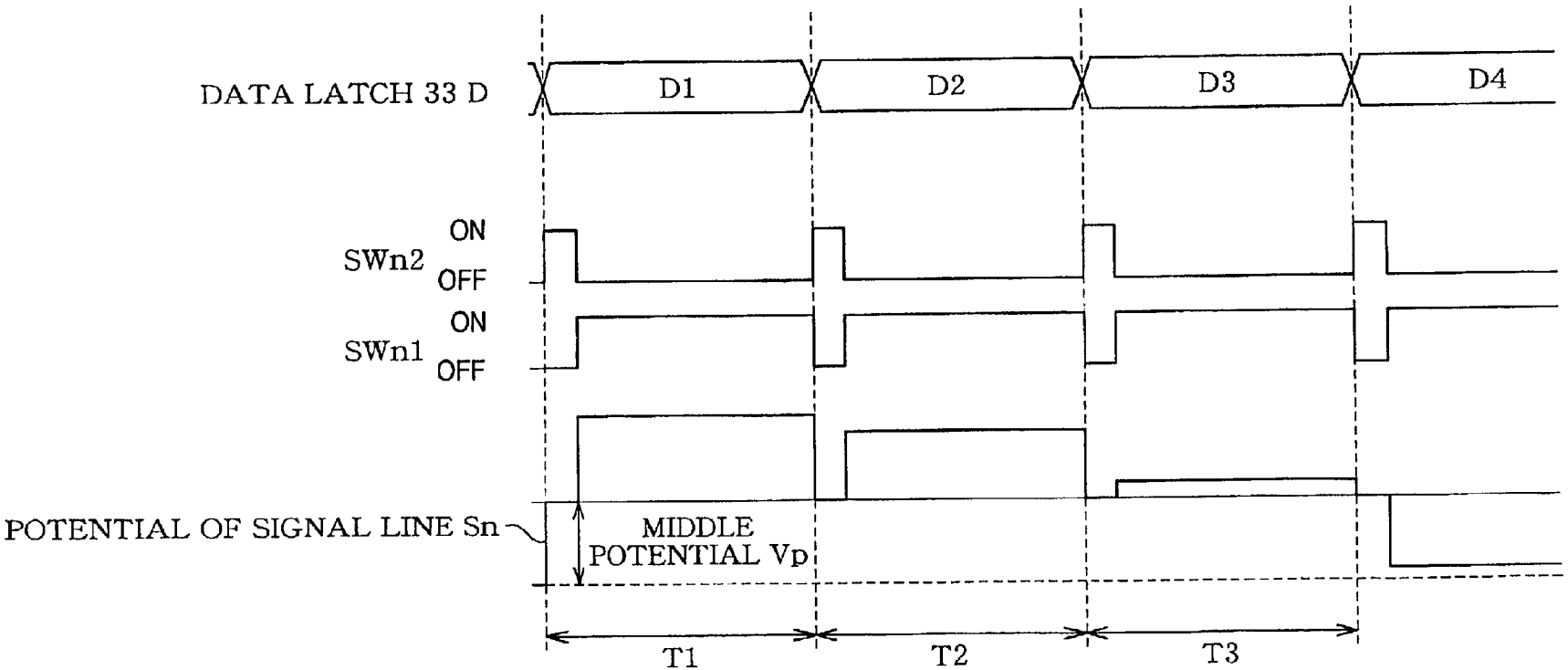
FIG. 11 is a timing chart showing an operation of the signal line driving circuit of FIG. 10.

Also, the signal line driving circuit in this embodiment includes the data latch 33, the decoder 34, the analog switch 35, the output circuit 36, the analog switches SW1, SW2 and the like, similarly to the conventional signal line driving circuit of FIG. 10. By the way, the signal line driving circuit in this embodiment is shown so as to correspond to only the signal line Sn for the easy illustration. Actually, the signal line driving circuits in this embodiment are laid out so as to correspond to the signal lines S1, S2 to Sn, respectively.

The latch 11 is connected to an output side of the data latch 33. Immediately before a data stored in the data latch 33 is updated by a signal LP, it captures a data outputted by the data latch 33 in accordance with a signal LC. Thus, the latch 11 can store the picture data displayed before the one horizontal period. Hence, the comparator 12 can compare the picture data before and after the one horizontal period with each other, on the basis of the output signal from the data latch 33 and the output signal from the latch 11.

Figure 9:
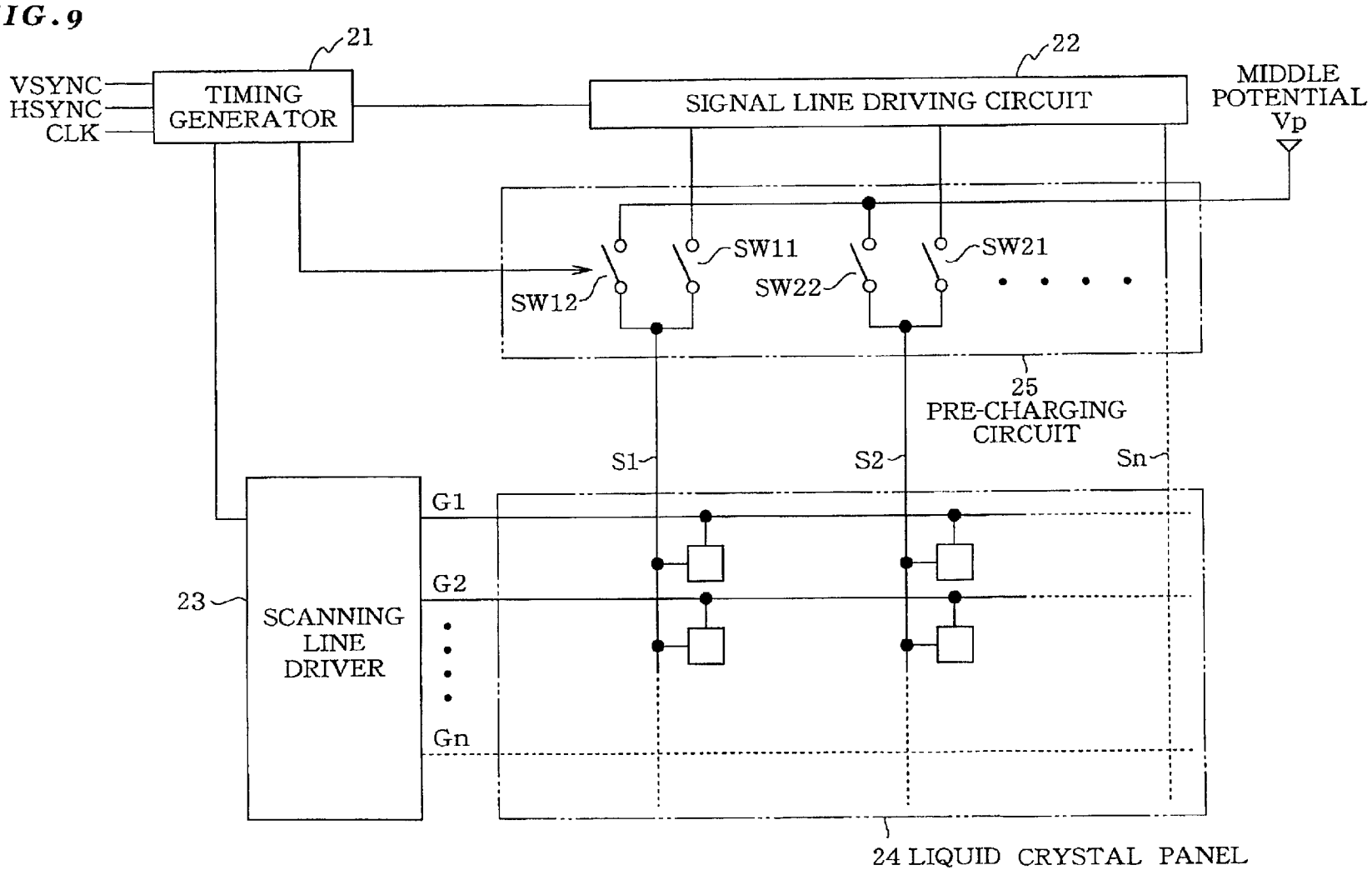
FIG. 9 is a circuit diagram showing a conventional liquid crystal display having a pre-charging circuit.

The switch controller 13 turns on and off the analog switches SW1, SW2 on the basis of an output signal SP sent from the timing generator (refer to FIG. 9) and the output signal from the comparator 12. When the switch SW1 is turned on, a gradation voltage is applied from the output circuit 36 to the signal line Sn. When the switch SW2 is turned on, the middle potential Vp is supplied to the signal line Sn.

In this way, the signal line driving circuit in this embodiment controls a timing when the middle potential Vp is applied to the signal line Sn, namely, a timing when the pre-charging operation is carried out, in accordance with the compared result of the picture data before and after the one horizontal period. Thus, when the same gradation voltage is applied in continuous horizontal periods, or when the gradation voltage applied in one frame period has the same polarity such as the line inversion drive, the consumptive electric power can be dropped by avoiding an unnecessary pre-charging operation.

Figure 2:
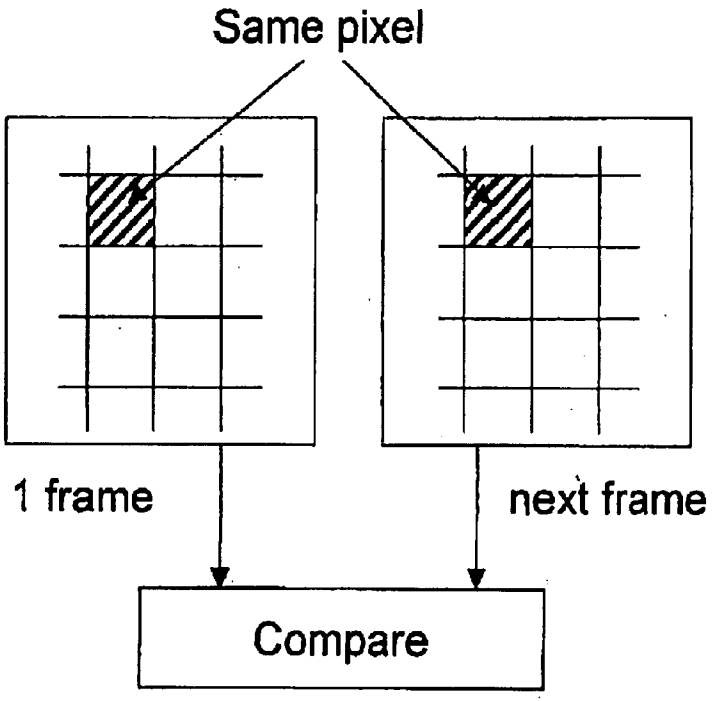
FIG. 2 is a block diagram showing a second embodiment of a signal line driving circuit according to the present invention.

FIG. 2 is a block diagram showing a second embodiment of a signal line driving circuit according to the present invention. It will be described below with reference to FIG. 2.

The signal line driving circuit in this embodiment further embodies the first embodiment. It is characterized in that it has a latch 51 and a comparator 52 serving as a picture data comparator for comparing a picture data before one horizontal period with a picture data to be next displayed for each signal line; and a switch controller 53 serving as a switch controlling unit for supplying the middle potential Vp in accordance with the compared result by the comparator 52.

Also, the signal line driving circuit in this embodiment includes a data latch 43, a decoder 44, an analog switch 45, an output amplifier 46, analog switches SW1, SW2 and the like. By the way, the signal line driving circuit in this embodiment is shown so as to correspond to only the signal line Sn for the easy illustration. Actually, the signal line driving circuits in this embodiment are laid out so as to correspond to the signal lines S1, S2 to Sn, respectively.

A picture data D has four bits, namely, 16 gradation voltages. The data latch 43 is a four-bit latch circuit. It stores the picture data D in accordance with the timing of the signal LP, and transfers the captured picture data D to the decoder 44, the latch 51 and the comparator 52. The picture data D is decoded into any of the 16 signals by the decoder 44, and outputted to the analog switch 45. The analog switch 45 is composed of a plurality of analog switch groups which are turned on and off in accordance with an input signal from the decoder 44, and it selects any one gradation voltage from voltages V0 to V16 inputted from the gradation voltage generator (refer to FIG. 10), and outputs it. The output amplifier 46 applies the input gradation voltage from the analog switch 45 through the switch SW1 to the signal line Sn. Also, the signal line Sn is connected through the switch SW2 to the middle potential Vp.

The latch 51 installed to store the picture data before the one horizontal period is a two-bit latch circuit, and stores two bits of a high order of the picture data D inputted from the data latch 43 in accordance with the timing of the signal LC, and then outputs it as a picture data D' to the comparator 52. The latch 51 captures the data immediately before the content of the data latch 43 is updated by the signal LP. Thus, it can store the picture data before the one horizontal period.

The comparator 52 is connected to the data latch 43, the latch 51 and the switch controller 53, and it receives the picture data D' before the one horizontal period sent from the latch 51 and the two bits of the high order of the picture data D sent from the data latch 43, and then compares both of them with each other. Also, the comparator 52 has a function of judging whether or not the two bits of the high order of the picture data D agree with the picture data D'.

The switch controller 53 is connected to the control terminals of the analog switches SW1, SW2, and it turns on and off the analog switches SW1, SW2 in accordance with a comparison result signal CMP from the comparator 52. When the analog switch SW1 is turned on, any gradation voltage outputted from the output amplifier 46 is applied to the signal line Sn. When the switch SW2 is turned on, the middle potential Vp is applied to the signal line Sn. Accordingly, the signal line Sn is pre-charged. As mentioned above, the signal line driving circuit in this embodiment controls the analog switch SW2 in accordance with the compared result between the picture data before and after the one horizontal period, and thereby controls the pre-charging operation.

Figure 3:
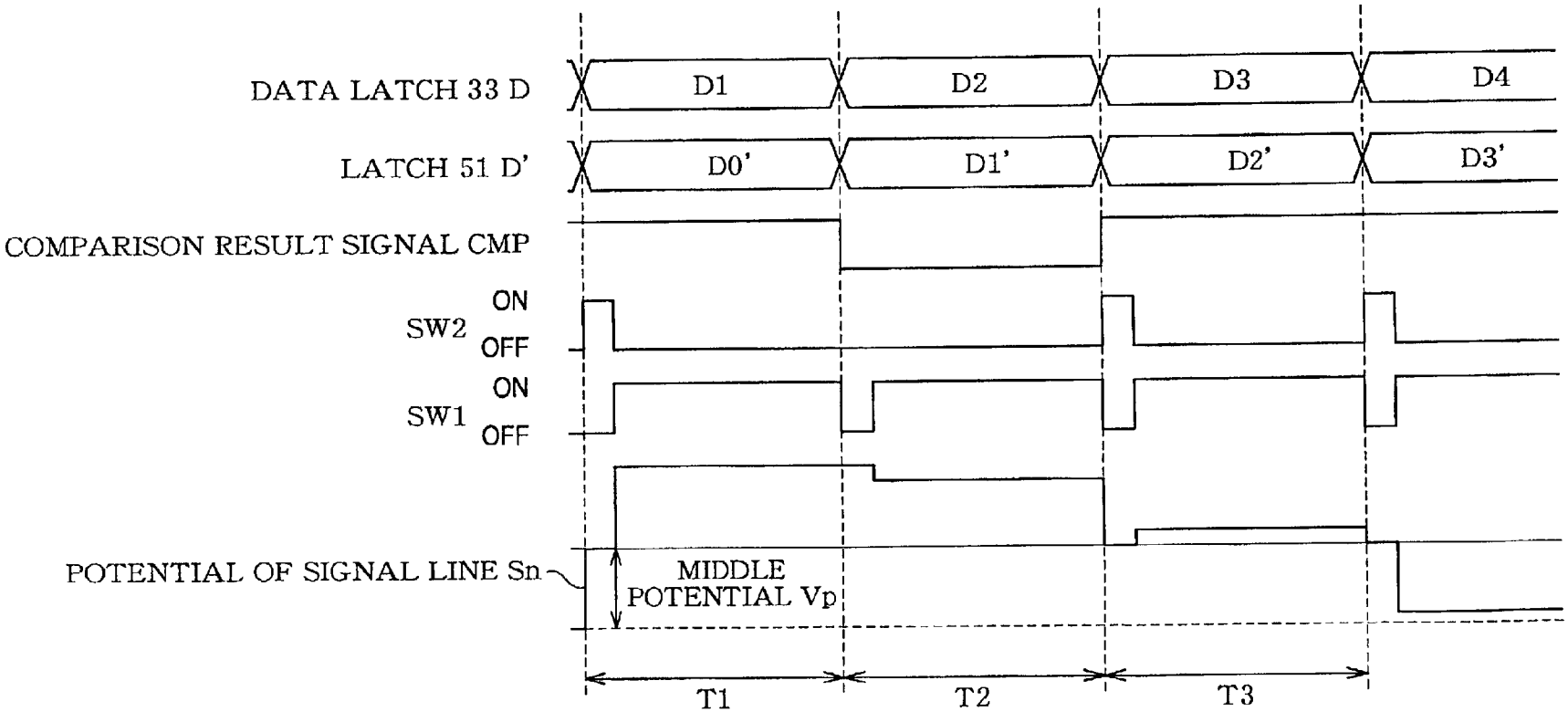
FIG. 3 is a timing chart showing an operation of the signal line driving circuit of FIG. 2.

FIG. 3 is a timing chart showing the operation of the signal line driving circuit of FIG. 2. It will be described below with reference to FIGS. 2 and 3.

When a first picture data D1 is sent to the signal line driving circuit, the picture data D1 is captured by the data latch 43, and transferred to the decoder 44. The gradation voltage corresponding to the picture data D1 is selected from the V0 to V16 by the decoder 44 and the analog switch 45. The selected gradation voltage is outputted to the output amplifier 46, and further sent through the switch SW1 to the signal line Sn.

Also, the two bits of the high order of the picture data D1 outputted from the data latch 43 are transferred to the latch 51 and the comparator 52. At this time, a picture data D0' of the two bits of the high order of the picture data displayed before the one horizontal period is stored in the latch 51. The comparator 52 is configured as an agreement circuit of a two-bit data, and it compares the two bits of the high order of the picture data D1 with the picture data D0', and then outputs the comparison result signal CMP to the switch controller 53.

If the compared result indicates a disagreement, namely, if the comparison result signal CMP=H, the switch controller 53 turns on the analog switch SW2, and pre-charges the signal line Sn to the pre-set middle potential Vp. In succession, it turns off the analog switch SW2, and simultaneously turns on the analog switch SW2, and thereby applies the gradation voltage outputted from the output amplifier 46 to the signal line Sn. The switching operation between the analog switches SW1 and SW2 is done at a pre-set timing (T1) in accordance with the signal SP outputted from the external timing generator.

In succession, a second picture data D2 is sent. Then, immediately before the data stored in the data latch 43 is updated, the latch 51 captures the two bits of the high order of the picture data D1 as the picture data D1' in accordance with the timing of the signal LC. Also, when the picture data D2 is captured by the data latch 43, the gradation voltage, corresponding to the picture data D2 is outputted from the output amplifier 46 through the decoder 44 and the analog switch 45, similarly to the above-mentioned case.

At the same time, the comparator 52 compares the picture data D1' of the latch 51 with the two bits of the high order of the picture data D2 outputted from the data latch 43. If those two picture data agree with each other, namely, if a potential difference between the gradation voltage selected by the picture data D2 and the gradation voltage selected by the picture data D1 sent before the one horizontal period is small, the comparator 52 outputs a comparison result signal CMP=L.

The small fluctuation in the potential of the signal line Sn enables the writing operation to be stably done without any pre-charging operation. Thus, the switch controller 53 does not carry out the pre-charging operation while turning off the analog switch SW2, and it turns on only the analog switch SW1. If the analog switch SW1 is turned on, the gradation voltage outputted from the output amplifier 46 is sent to the signal line Sn (T2).

Similarly, when the latch 51 captures the high order two-bit D2' and a third picture data D3 is inputted to the data latch 43, the comparator 52 compares the picture data D2' of the latch 51 with two bits of a high order of the picture data D3. Since those two picture data do not agree with each other, this results in the comparison result signal CMP=H. Thus, the analog switches SW1, SW2 are turned on in turn. Hence, the signal line Sn is pre-charged to the middle potential Vp. In succession, a gradation voltage corresponding to the picture data D3 is sent (T3).

Figure 4:
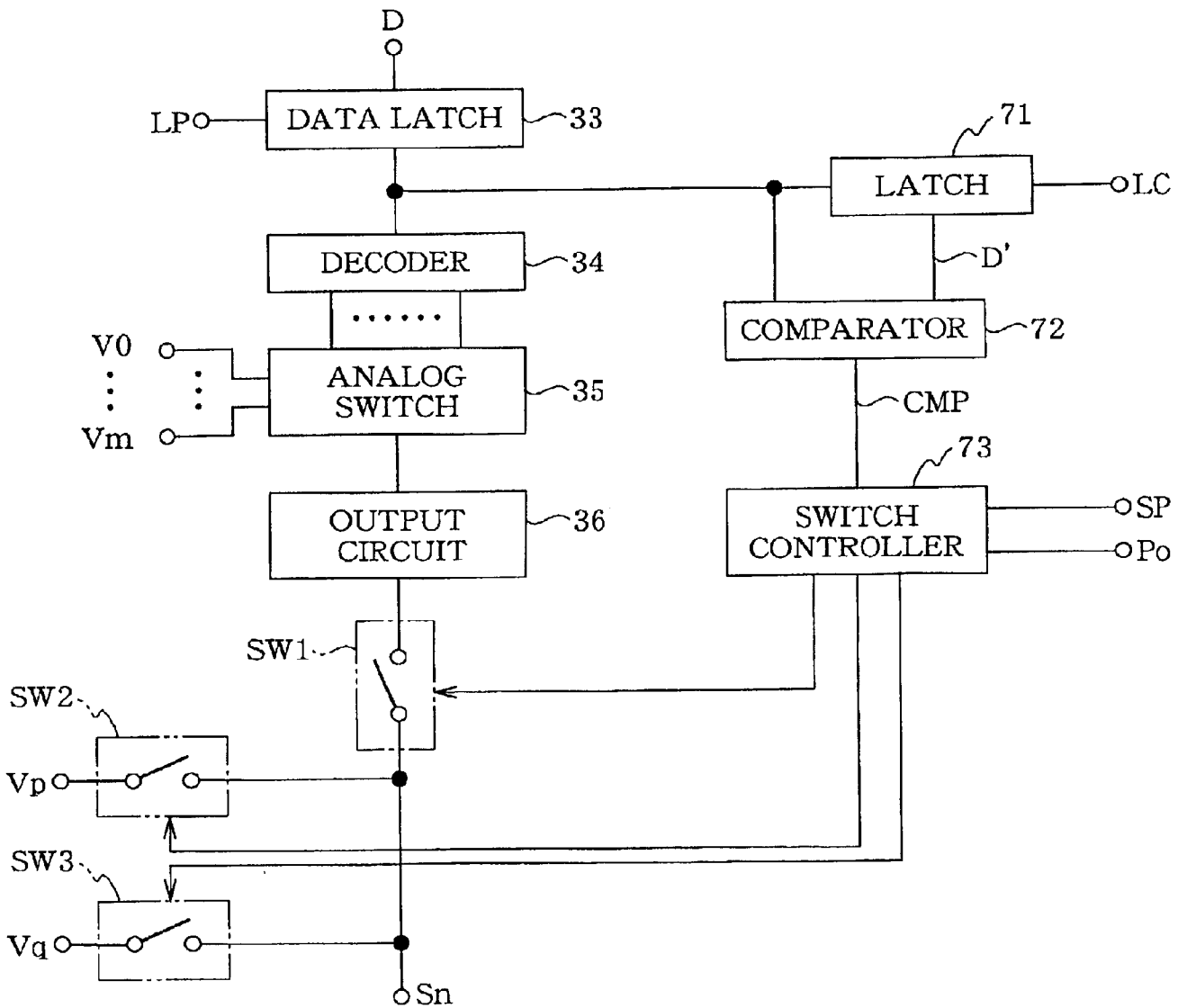
FIG. 4 is a block diagram showing a third embodiment of a signal line driving circuit according to the present invention.

FIG. 4 is a block diagram showing a third embodiment of a signal line driving circuit according to the present invention. It will be described below with reference to FIG. 4.

The signal line driving circuit in this embodiment is an actual example in which the first embodiment is applied to an alternating current inversion driving type. It is characterized in that it has a latch 71 and a comparator 72 serving as a picture data comparing unit for comparing a picture data before one horizontal period with a picture data to be next displayed for each signal line, and a switch controller 73 serving as a switch controlling unit for supplying middle potentials Vp, Vq corresponding to the compared result by the comparator 72.

Also, the signal line driving circuit in this embodiment has the data latch 33, the decoder 34, the analog switch 35, the output circuit 36, the analog switches SW1, SW2 and SW3 and the like. By the way, the signal line driving circuit in this embodiment is shown so as to correspond to only the signal line Sn for the easy illustration. Actually, the signal line driving circuits in this embodiment are disposed so as to correspond to the signal lines S1, S2, . . . , Sn, respectively.

The latch 71 is an n-bit latch circuit. Immediately before the content of the data latch 33 is updated, it captures the n-bits of the high order of the picture data outputted from the data latch 33 or all bits thereof, and stores them. The comparator 72 compares the n-bits of the picture data before and after the one horizontal period received from the data latch 33 and the latch 71 with each other, and then outputs a comparison result signal CMP to the switch controller 73. The switch controller 73 controls so as to turn on and off the analog switches SW1, SW2 and SW3 at a pre-set timing, on the basis of the comparison result signal CMP and a polarity inversion signal Po.

The signal line Sn is pre-charged to the middle potential Vp or Vq since the analog switch SW2 or SW3 is turned on. However, the middle potential Vp is set to a positive side from a common potential Vcom, and the middle potential Vq is set to a negative side from the common potential Vcom.

Figure 5:
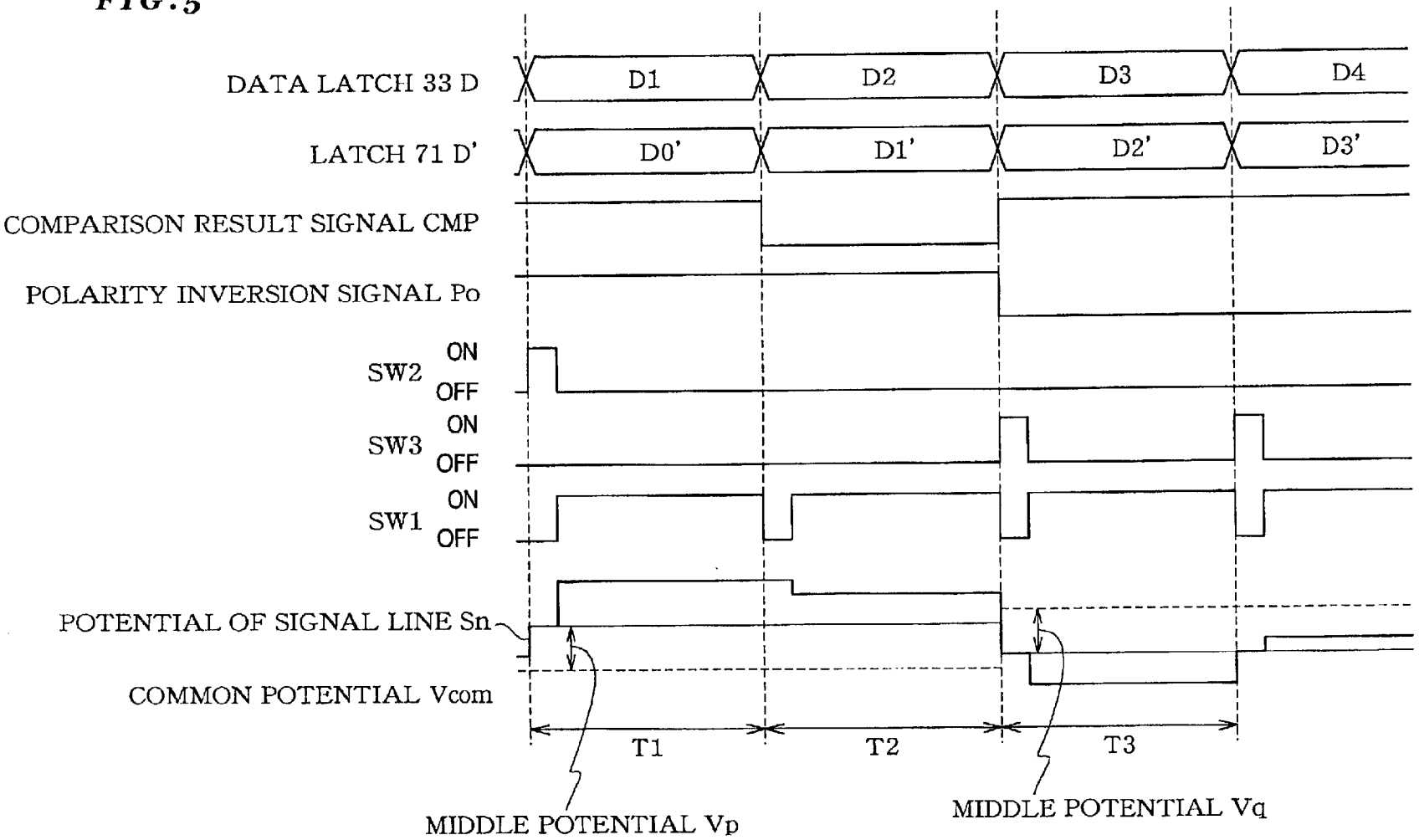
FIG. 5 is a timing chart showing an operation of the signal line driving circuit of FIG. 4.

FIG. 5 is a timing chart showing the operation of the signal line driving circuit of FIG. 4. It will be described below with reference to FIGS. 4 and 5.

FIG. 5 shows the timing of the operation of the signal line driving circuit using this polarity inversion signal Po. At a time of a drive on a positive side (Po=H), the comparator 72 compares the n bits of the high order of the first picture data D1 with the picture data D0' of the latch 71, similarly to the second embodiment. If they do not agree with each other, the switch controller 73 turns on the analog switch SW2, and then pre-charges the signal line Sn to the middle potential Vp, and further turns off the analog switch SW2, and also turns on the analog switch SW1, and then applies the gradation voltage corresponding to the picture data D1 to the signal line Sn (T1).

When the second picture data D2 is sent, since the picture data D2 agrees with the n bits of the high order of the first picture data D1 (CMP=L), the pre-charging operation is not done. Thus, the switch controller 73, while turning off the analog switch SW2, turns on only the analog switch SW1, and accordingly applies the gradation voltage to the signal line Sn (T2).

When the polarity inversion signal Po becomes at L, the gradation voltage is inverted to the negative polarity. Thus, the switch controller 73 turns on the analog switch SW3 irrespectively of the comparison result signal CMP, and thereby pre-charges the signal line Sn to the middle potential Vq on the negative side. After that, the switch controller 73 turns on the analog switch SW1, and thereby applies the gradation voltage corresponding to the third picture data D3 to the signal line Sn (T3).

Similarly, if the polarity is inverted from the negative side drive to the positive side drive, the analog switch SW2 is turned on irrespectively of the comparison result signal CMP of the compared result. Thus, the signal line Sn is pre-charged to the middle potential Vp. In this way, according to the signal line driving circuit in this embodiment, even if the polarity inversion drive is carried out, the pre-charging operation can be controlled to thereby attain the smaller consumptive electric power.

In other words, when the voltage of the same polarity is applied to the liquid crystal device arranged on the liquid crystal panel in one frame period such as the line inversion driving type, if the gradation voltages written to liquid crystal pixels adjacent to each other on a row are equal to each other, the sufficiently stable writing operation can be carried out without any pre-charging operation.

Figure 6:
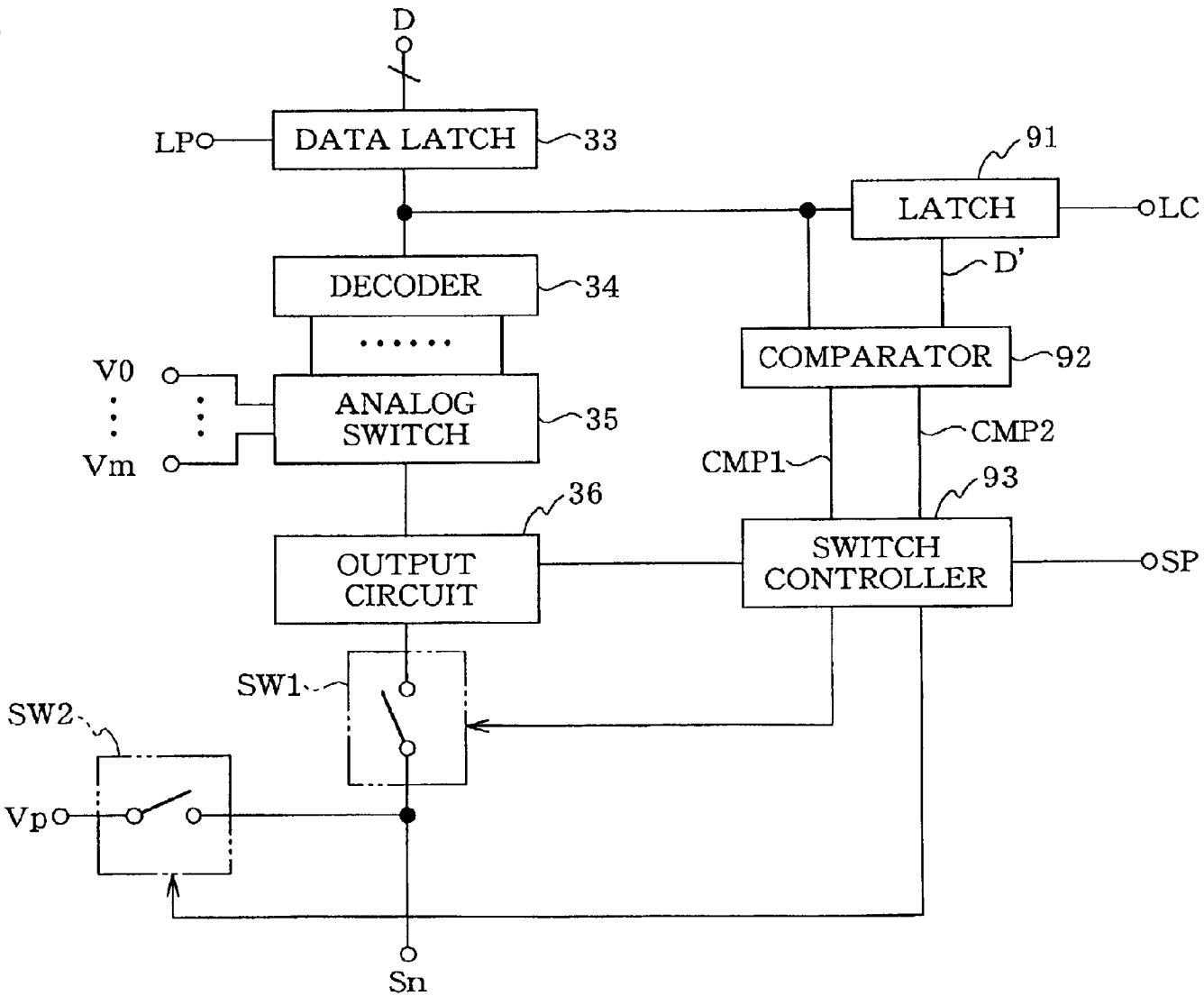
FIG. 6 is a block diagram showing a fourth embodiment of a signal line driving circuit according to the present invention.
Figure 7:
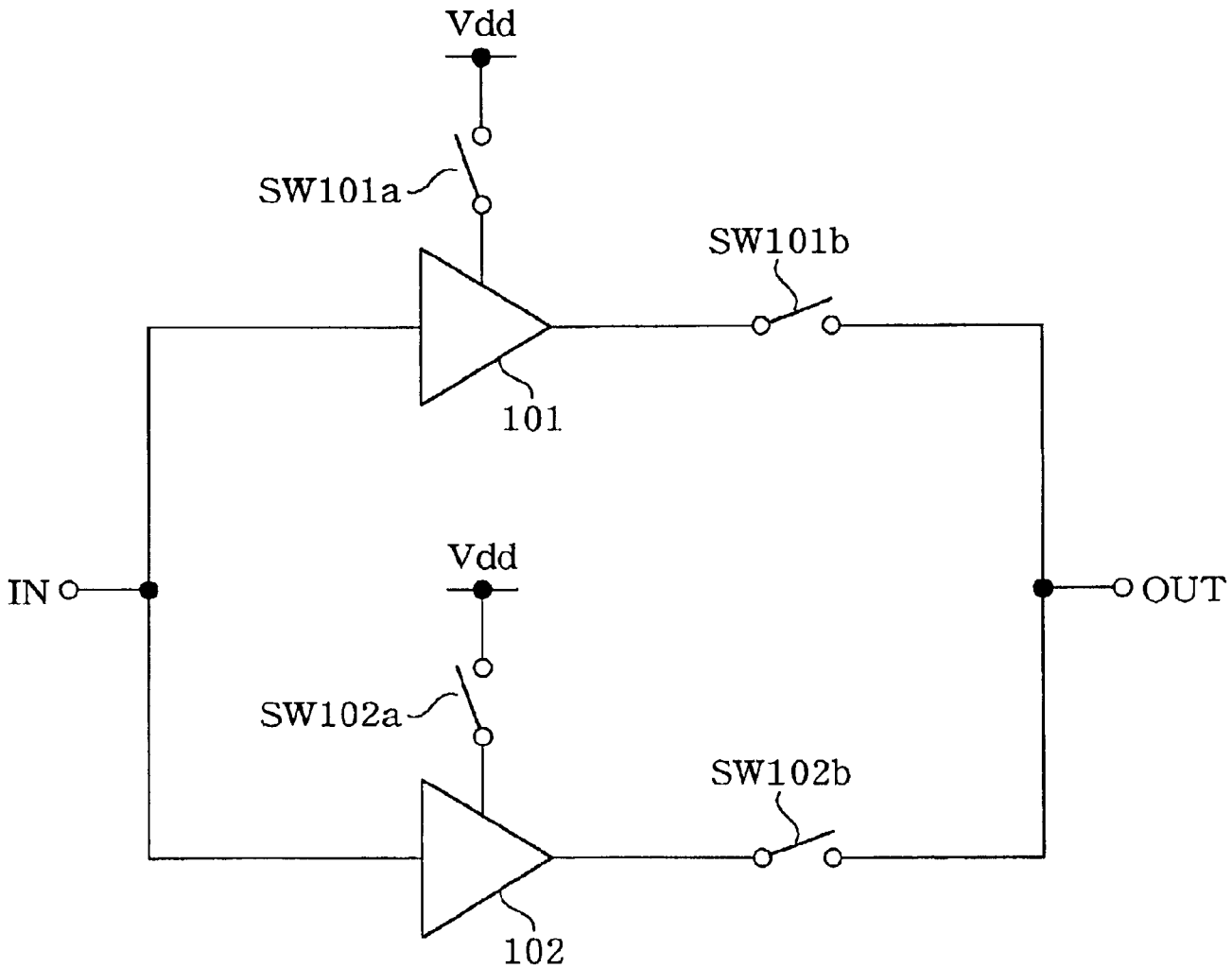
FIG. 7 is a circuit diagram showing an output circuit in the signal line driving circuit of FIG. 6.

FIG. 6 is a block diagram showing a fourth embodiment of a signal line driving circuit according to the present invention. FIG. 7 is a circuit diagram showing an output circuit in the signal line driving circuit of FIG. 6. It will be described below with reference to FIGS. 6 and 7.

The signal line driving circuit in this embodiment is characterized in that it has a latch 91 and a comparator 92 serving as a picture data comparing unit for comparing a picture data before one horizontal period with a picture data to be next displayed for each signal line, and a switch controller 93 serving as a switch controlling unit for supplying the middle potential vp corresponding to the compared result by the comparator 92.

Also, the signal line driving circuit in this embodiment has the data latch 33, the decoder 34, the analog switch 35, the output circuit 36, the analog switches SW1, SW2 and the like. By the way, the signal line driving circuit in this embodiment is shown so as to correspond to only the signal line Sn for the easy illustration. Actually, the signal line driving circuits in this embodiment are disposed so as to correspond to the signal lines S1, S2, . . . , Sn, respectively.

In the second and third embodiments, the function of controlling the pre-charging operation is carried out in accordance with the agreement judgment with regard to the high order bits of the picture data. On the contrary, this embodiment gives the function of comparing the size between the picture data to the comparator 92.

As shown in FIG. 7, the output circuit 36 is provided with an Nch receiving operational amplifier 101, a Pch receiving operational amplifier 102, switch groups SW101*a*, SW101*b*, SW102*a* and SW102*b* and the like. The Nch receiving operational amplifier 101 is mainly used to apply a charge to the signal line Sn, and the Pch receiving operational amplifier 102 is mainly used to drop the potential of the signal line Sn.

The latch 91 is configured so as to store all the bits of the picture data D outputted from the data latch 33. The comparator 92 has the function of judging an agreement between the one bits of the high orders of the picture data before and after the one horizontal period and the function of comparing the sizes between both the picture data themselves, and outputs a comparison result signal between the one bits of the high orders as a CMP1 and a comparison result signal between the sizes as a CMP2 to the switch controller 93. The switch controller 93 outputs a control signal to the control terminals of the analog switches SW1, SW2 and the control terminals of the switches SW101*a*, SW101*b*, SW102*a* and SW102*b* shown in FIG. 7, and switches so as to turn on and off them.

Figure 8:
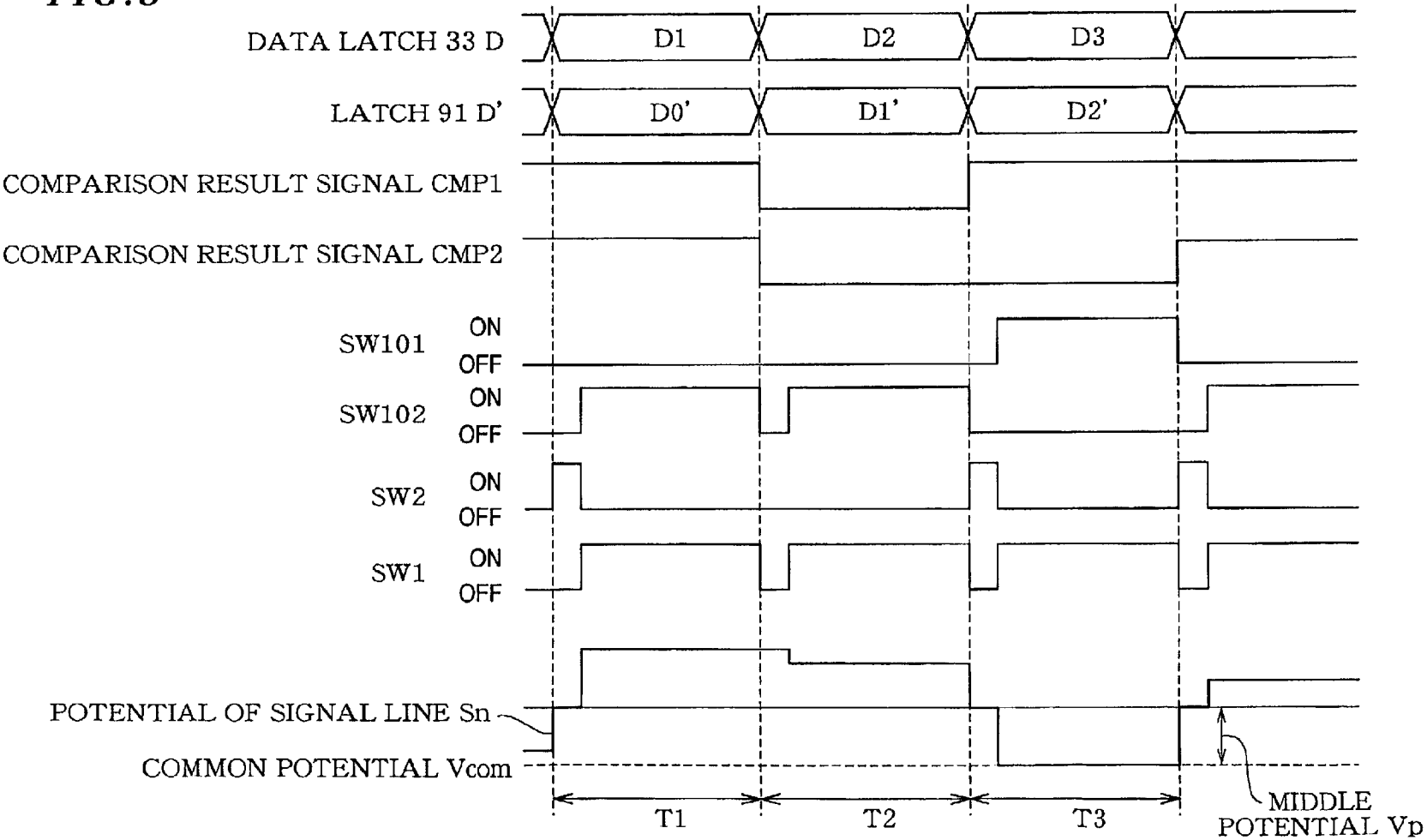
FIG. 8 is a timing chart showing an operation of the signal line driving circuit of FIG. 6.

FIG. 8 is a timing chart showing the operation of the signal line driving circuit of FIG. 6. It will be described below with reference to FIGS. 6 to 8.

A SW 101 of FIG. 8 collectively indicates the SW101*a* and the SW101*b* of FIG. 7, and a SW 102 of FIG. 8 collectively indicates the SW102*a* and the SW102*b*, respectively.

When the first picture data D1 is captured by the data latch 33, the comparator 92 judges an agreement between the one bits of the high orders of the picture data D1 and the picture data D0' captured by the latch 91, and outputs the comparison result data CMP1. If those two picture data D do not agree (CMP1=H), the switch controller 93 turns on the switch SW2, and thereby pre-charges the signal line Sn.

Also, the comparator 92 compares the size of the picture data D1 with that of the picture data D0', and outputs the comparison result data CMP2. If CMP2=H, namely, the gradation voltage corresponding to the picture data D1 is greater than the gradation voltage corresponding to the picture data D0', the switch controller 93 turns on the switches SW101*a*, SW101*b* of the output circuit 36 and the analog switch SW1 after the signal line Sn is pre-charged. Accordingly, the operational amplifier 101 applies the gradation voltage selected by charging the charges to the signal line Sn (T1).

When the first picture data D1 is captured by the latch 91 and the second picture data D2 is inputted, since the high order bits of the picture data D1' and the picture data D2 agree with each other, the comparator 92 sets the comparison result data CMP1 to L. Then, the analog switch SW2 remains off, and the pre-charging operation is not done. Also, the picture data D2 has the value smaller than that of the picture data D1'. Thus, the comparison result data CMP2 becomes at L. For this reason, the switch controller 93 turns on the switches SW102*a*, SW102*b* and the analog switch SW1, and thereby operates the operational amplifier 102. Then, the potential of the signal line Sn is dropped to accordingly apply the gradation voltage corresponding to the picture data D2 to the signal line Sn (T2).

When the third picture data D3 is inputted, the analog switch SW2 is turned on in accordance with the compared result between the picture data D3 and the picture data D2' of the latch 91. Thus, the signal line Sn is pre-charged to the middle potential Vp. In succession, since the switches SW102*a*, SW102*b* and the analog switch SW1 are turned on, the operational amplifier 102 applies the gradation voltage corresponding to the picture data D3 to the signal line Sn (T3).

This embodiment is designed so as to control the pre-charging operation in accordance with the comparison between the high order bits of the picture data before and after the one horizontal period, and compare the sizes of those picture data D with each other, and properly use the two kinds of the operational amplifiers. Usually, the output amplifier is designed such that the Nch receiving operational amplifier and the Pch receiving operational amplifier are assembled in order to embed the gaps of a rising speed and a trailing speed, in many cases. Also, since the driving performance enough to operate the liquid crystal panel is required, it is difficult to suppress a steady current flowing through the operational amplifier. However, according to this embodiment, the picture data are compared to thereby select the amplifier to be driven, and a power supply voltage is not applied to the unused operational amplifier. Thus, the steady current flowing through the operational amplifier can be suppressed without any deterioration in the output response property. Hence, it is possible to attain the liquid crystal driving circuit in which the consumptive electric power is further reduced.

Of course, the present invention is not limited to the above-mentioned respective embodiments. For example, the respective embodiments are designed so as to compare the digital picture data captured by the latch with each other. However, for example, it may be designed to use a comparator and a sample holding circuit to then compare a size of an analog data.

In the signal line driving circuit and the signal line driving method according to the present invention, the change amount between the gradation voltage applied before the one horizontal period and the gradation voltage to be next applied is small. Thus, if the writing operation can be stably done at a high speed without any pre-charging operation, the non-execution of the pre-charging operation can reduce the loss of the current necessary for the pre-charging operation. Hence, it is possible to attain the liquid crystal display that can be driven at the small consumptive electric power.

The invention may be embodied in other specific forms without departing from the spirit or essential characteristic thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

The entire disclosure of Japanese Patent Application No. 2001-27042 (Filed on Feb. 2, 2001) including specification, claims, drawings and summary are incorporated herein by reference in its entirety.

What is claimed is:

1. A signal line driving circuit for applying a pre-charging voltage and a gradation voltage corresponding to a picture data to a plurality of signal lines comprising:

a picture data comparator for comparing, for each signal line, picture data between two consecutive horizontal periods by comparing said picture data before one horizontal period with said picture data to be next displayed in the one horizontal period; and a switch controller for controlling a supply of said pre-charging voltage in accordance with a result compared by said picture data comparator.

2. A signal line driving circuit according to claim 1, wherein said switch controller does not apply said pre-charging voltage if said gradation voltage of said picture data to be next displayed is within a certain range of said gradation voltage of said picture data before one horizontal period, and said pre-charging voltage being independent from said gradation voltage.

3. A signal line driving circuit according to claim 1, wherein said switch controller does not apply said pre-charging voltage if said gradation voltage of said picture data to be next displayed agrees with said gradation voltage of said picture data before one horizontal period.

4. A signal line driving circuit according to claim 1, wherein said switch controller applies said pre-charging voltage only if a polarity of said gradation voltage of said picture data to be next displayed is different from a polarity of said gradation voltage of said picture data before one horizontal period.

5. A signal line driving circuit according to claim 2, wherein said switch controller applies said pre-charging voltage if a polarity of said gradation voltage of said picture data to be next displayed is different from a polarity of said gradation voltage of said picture data before one horizontal period.

6. A signal line driving circuit according to claim 3, wherein said switch controller applies said pre-charging voltage if a polarity of said gradation voltage of said picture data to be next displayed is different from a polarity of said gradation voltage of said picture data before one horizontal period.

7. A signal line driving circuit according to claim 1, wherein said switch controller applies said gradation voltage by using a first operational amplifier suitable for a boosting operation if said gradation voltage of said picture data to be next displayed is higher than said gradation voltage of said picture data before one horizontal period, applies said gradation voltage by using a second operational amplifier suitable for a voltage drop operation if said gradation voltage of said picture data to be next displayed is lower than said gradation voltage of said picture data before one horizontal period, and applies said gradation voltage by using any one of said first and second operational amplifiers if said gradation voltage of said picture data to be next displayed is equal to said gradation voltage of said picture data before one horizontal period.

8. A signal line driving method for applying a pre-charging voltage and a gradation voltage corresponding to a picture data to a plurality of signal lines, the method comprising the step of:

for each signal line, comparing picture data between two consecutive horizontal periods by comparing said picture data before one horizontal period with said picture data to be next displayed in the one horizontal period; and controlling a supply of said pre-charging voltage in accordance with that compared result.

9. A signal line driving method according to claim 8, wherein it does not apply said pre-charging voltage if said gradation voltage of said picture data to be next displayed is within a certain range of said gradation voltage of said picture data before one horizontal period.

10. A signal line driving method according to claim 8, wherein it does not apply said pre-charging voltage if said gradation voltage of said picture data to be next displayed agrees with said gradation voltage of said picture data before one horizontal period.

11. A signal line driving method according to claim 9, wherein it applies said pre-charging voltage only if a polarity of said gradation voltage of said picture data to be next displayed is different from a polarity of said gradation voltage of said picture data before one horizontal period.

12. A signal line driving method according to claim 9, wherein it applies said pre-charging voltage if a polarity of said gradation voltage of said picture data to be next displayed is different from a polarity of said gradation voltage of said picture data before one horizontal period.

13. A signal line driving method according to claim 10, wherein it applies said pre-charging voltage if a polarity of said gradation voltage of said picture data to be next displayed is different from a polarity of said gradation voltage of said picture data before one horizontal period.

14. A signal line driving method according to claim 8, wherein it applies said gradation voltage by using a first operational amplifier suitable for a boosting operation if said gradation voltage of said picture data to be next displayed is higher than said gradation voltage of said picture data before one horizontal period, applies said gradation voltage by using a second operational amplifier suitable for a voltage drop operation if said gradation voltage of said picture data to be next displayed is lower than said gradation voltage of said picture data before one horizontal period, and applies said gradation voltage by using any one of said first and second operational amplifiers if said gradation voltage of said picture data to be next displayed is equal to said gradation voltage of said picture data before one horizontal period.

15. A signal line driving circuit, comprising:

a signal line connection for supplying signal line potential to an active matrix display signal line during consecutive horizontal time periods, a first portion of each time period being reserved for supplying a fixed value pre-charging voltage and a second portion of each time period being reserved for supplying a picture data gradation voltage;

a middle potential (Vp) terminal for providing the fixed value pre-charging voltage;

a gradation voltage source corresponding to a picture data to a plurality of signal lines and providing the picture data gradation voltage, the gradation voltage source comprising a last data latch (11) for holding picture data from a last horizontal period before a current horizontal period, a comparator (12), connected to an output of the last data latch, for comparing the picture data from the last horizontal period with a picture data to be next displayed during the current horizontal period, for each signal line, and a switch controller (13) for supplying the middle potential (Vp) to the signal line connection, as the pre-charging voltage, in accordance with a compared result by the comparator, the gradation voltage and the pre-charging voltage being applied to the signal line connection at mutually exclusive times.

16. The driving circuit of claim 15, further comprising:

current data latch (33) for receiving the picture data to be next displayed for each signal line, the current data latch providing picture data to the last data latch;

a decoder (34) connected to an output of the current data latch;

an analog switch (35) connected to an output of the decoder and supplying gradation voltages corresponding to the picture data to be next displayed;

an output circuit (36) connected to an output of the analog switch;

a first switch (SWl) connected on an input side to an output of the output circuit, and connected on an output side to the signal line connection; and a second switch (SW2) connected on an input side to the middle voltage terminal, and connected on an output side to the signal line connection, the first switch and the second switch operating under control of the switch controller so that when the first switch is turned on, the gradation voltage is applied from the output circuit to the signal line connection, and when the second switch is turned on, the middle potential is supplied to the signal line connection as the pre-charging voltage.

17. The driving circuit of claim 16, further comprising:

a third switch under control of the switch controller; and another middle potential connection (Vq) connected via the third switch to the signal line connection to pre-charge the signal line connection in alternating current inversion driving, wherein, the switch controller has a polarity inversion signal input, the comparator compares n-bits of the picture data from the last data latch with n-bits of the picture data to be next displayed for each signal line, and then outputs the comparison result to the switch controller, the switch controller controls so as to turn on and of f the first, second and third switches, on the basis of the comparison result signal CMP and the inputted polarity inversion signal.

18. The driving circuit of claim 15, wherein, when said gradation voltage of said picture data to be next displayed agrees with said gradation voltage of said picture data before one horizontal period, and when said gradation voltage of said picture data to be next displayed is within a certain range of said gradation voltage of said picture data before one horizontal period, said switch controller does not apply said pre-charging voltage to said signal line connection.

19. The driving circuit of claim 15, wherein said switch controller applies said pre-charging voltage only if a polarity of said gradation voltage of said picture data to be next displayed is different from a polarity of said gradation voltage of said picture data before one horizontal period.

20. The driving circuit of claim 15, wherein said switch controller:

applies said gradation voltage by using a first operational amplifier suitable for a boosting operation if said gradation voltage of said picture data to be next displayed is higher than said gradation voltage of said picture data before one horizontal period, applies said gradation voltage by using a second operational amplifier suitable for a voltage drop operation if said gradation voltage of said picture data to be next displayed is lower than said gradation voltage of said picture data before one horizontal period, and applies said gradation voltage by using any one of said first and second operational amplifiers if said gradation voltage of said picture data to be next displayed is equal to said gradation voltage of said picture data before one horizontal period.

21. The signal line driving circuit of claim 1, wherein, said comparator cooperates high order bits of the picture data with high order bits of the next picture data.

22. The signal line driving circuit of claim 21, wherein, said driving circuit further comprises a latch circuit only latching said high order bits.

23. The signal line driving circuit of claim 1, wherein, the picture data comparator compares, for each signal line, picture data between two consecutive horizontal periods, within a same picture frame, by comparing said picture data before one horizontal period with said picture data to be next displayed in the one horizontal period.

* * * * *